United States Patent [19]

Stater

[11] Patent Number: 4,973,051

[45] **Date of Patent: * Nov. 27, 1990**

[54] APPARATUS FOR ADJUSTING FREE-MOVING WEIGHT TRAINING MACHINES

[76] Inventor: Vernon L. Stater, 1140 Kimberly Pl., Redlands, Calif. 92373

[ * ] Notice: The portion of the term of this patent subsequent to Sep. 25, 2007 has been disclaimed.

[21] Appl. No.: 317,902

[22] Filed: Mar. 2, 1989

[51] Int. Cl.[5] ..... A63B 21/078

[52] U.S. Cl. ..... 272/123

[58] Field of Search ..... 272/62, 70.2, 93, 103, 272/109, 110, 117, 118, 123, 134, DIG. 4; 248/224.4; 211/57.1, 59.1

[56] References Cited

U.S. PATENT DOCUMENTS

| | | | |
|---|---|---|---|
| 4,527,797 | 7/1985 | Slade, Jr. et al. | 272/123 |
| 4,540,171 | 9/1985 | Clark et al. | 272/118 |
| 4,564,194 | 1/1986 | Dawson | 272/123 |
| 4,700,944 | 10/1987 | Sterba et al. | 272/117 |
| 4,744,560 | 5/1988 | Azari | 272/123 |

FOREIGN PATENT DOCUMENTS

| | | | |
|---|---|---|---|
| 456790 | 3/1928 | Fed. Rep. of Germany | 272/123 |

*Primary Examiner*—Robert Bahr

*Attorney, Agent, or Firm*—Lyon & Lyon

[57] ABSTRACT

An apparatus for adjusting the rest height of free-moving weight-training machines in which a support plug is slidably inserted into one of several pockets in the upright standards of the weight-training machine. The plugs fit in pockets which are angled upward in the upright standards or, alternatively, the plugs extending out of the inclined standards at a 90° angle, with the standards themselves inclined away from the user. The barbell used in the exercise rests upon the extended portion of the support plug in each upright standard and the rest height of the barbell can be varied by choosing one of several available pockets for containing the support plug in each upright support.

7 Claims, 1 Drawing Sheet

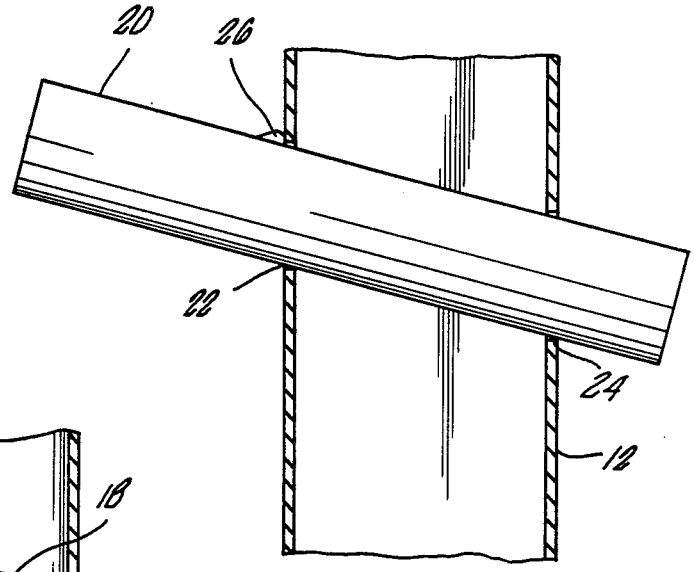
FIG. 4
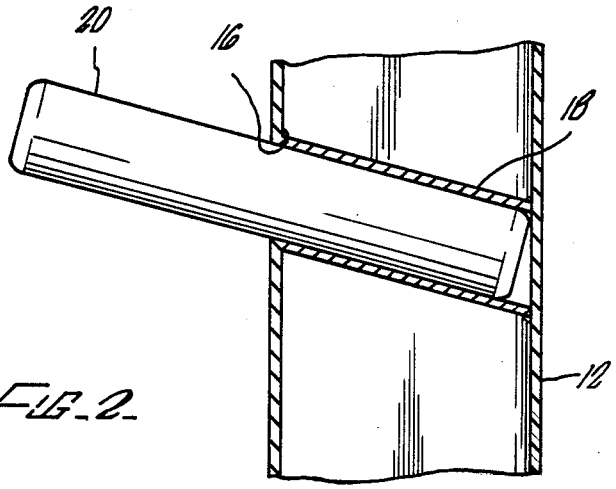
FIG. 2
FIG. 3
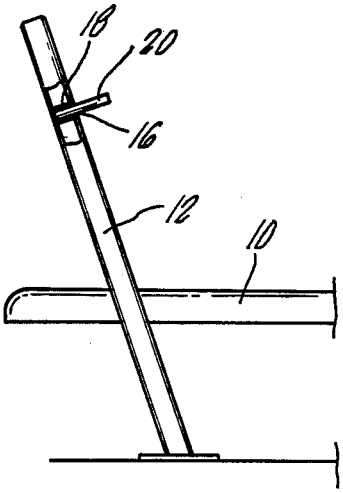
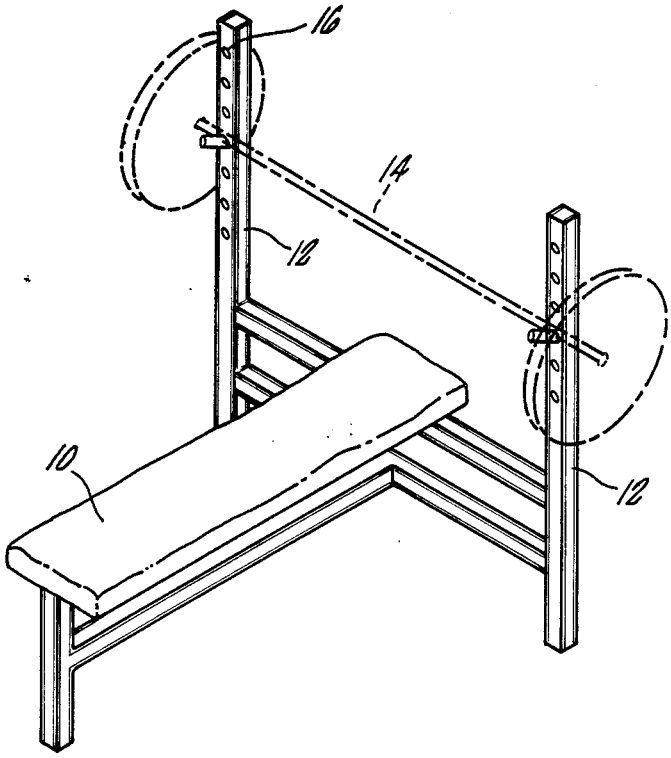
FIG. 1

APPARATUS FOR ADJUSTING FREE-MOVING WEIGHT TRAINING MACHINES

This Application is a continuation-in-part of Ser. No. 264,144, filed Oct. 28, 1988, pending.

BACKGROUND OF THE INVENTION

The field of the present invention is weight-training equipment.

Weight-training equipment, particularly equipment utilizing free-moving weights unconnected to a machine structure, must be adjustable for users of differing heights. For instance, a bench-press free-weight machine involving a barbell which exercises the chest muscles must have a resting height which is adjustable for users having arms of differing lengths. Similarly, a squat machine utilizing a barbell which is placed behind a user's head must have a resting height which is adjustable for users having differing heights.

Typical of methods used in the art to solve the problem of adjustable resting heights of the machines are to be found in U.S. Pat. Nos. 4,201,380 and 4,302,009. In '380 the upright standards used to support a barbell have cut-outs spaced throughout the working height of the standards. At rest, the barbell may be placed in the appropriate cut-out. Similarly, '009 discloses a method of height adjustability whereby the standards contain short metal plates welded to each standard and spaced along its length to support the barbell. Each method, however, possesses a major drawback. In '380, the user or assistant must guide the weight into a supporting cut-out in the standard at the end of the exercise. This action requires a degree of strength and dexterity not always possessed by a user at the end of an exercise. In '009, the projections from the standards above and below the selected projection tend to interfere with the movement of the exercise. Thus, there is a need in the art for an adjustable-height support for weight-training machines in which there is no interference with the range of motion of the user in any particular exercise and which still possesses the capability of catching a falling weight at the end of the exercise.

SUMMARY OF THE INVENTION

The present invention is directed at an apparatus for adjusting free-moving weight-training machines in which the barbell is securely supported in upright standards by metal support plugs which slidably fit into holes in the standards. The apparatus contemplated provides simple resting height adjustment and facile placement of the barbell on the stand.

In a first aspect of the present invention, the resting height of the barbell can be varied by choosing one of the several available positions to contain the support plug in each upright standard. The positions and the support plugs which are inserted therein are angled upwardly in order to keep the support plugs within the selected positions and to keep the barbell from rolling off the support plugs when at rest. In addition, the single protrusion allows the user to guide the weight precisely to a resting place when it is above the support plug without the need to precisely locate a notch. In order to facilitate ease of adjustability, the protruding support plugs may be easily moved from position to position by one person by lifting each end of the barbell serially as the plugs are moved into the appropriate position.

In a second aspect of the present invention, the support plugs are inserted into positions located at a 90° angle to each upright standard, with the upright standards themselves being angled backward away from the user in order to keep the support plugs within the selected positions and to keep the barbell from rolling off the support plugs when at rest.

Accordingly, it is an object of the present invention to improve the ease of adjustability of free-moving weight-training machines while reducing the interference the supporting structure could have upon the range of motion in the user's weight-pressing exercise and without sacrificing the inherent safety associated with using protruding plugs for support of the barbell. Other and further objects and advantages will appear hereinafter.

BRIEF DESCRIPTION OF THE DRAWINGS

FIG. 1 is a perspective view of the invention as implemented on a typical bench-press weight-training machine.

FIG. 2 is a cross-sectional view of a preferred embodiment of the invention in which a support plug rests in an available pocket angled at less than 90° in an upright standard of a weight-training machine.

FIG. 3 is a cross-sectional view of a second embodiment of the invention in which a support plug rests in an available pocket angled at 90° in an angled-back upright standard of a weight-training machine.

FIG. 4 is a cross-sectional view of a third embodiment of the invention in which a support plug passes through a pair of holes in an upright standard.

DETAILED DESCRIPTIONS OF THE PREFERRED EMBODIMENT

The apparatus described here for adjusting free-weight training machines is applicable to any device which uses a barbell and upright standards. The most common examples of these devices are the bench press, inclined bench press, shoulder press, and squat rack but the invention is not limited to these applications.

The apparatus comprising the invention typically includes a bench 10, which may or may not be connected to two associated upright standards 12. The upright standards 12 are positioned adjacent to the bench 10 in such a way that the user lying upon the bench 10 can easily and effectively grasp the barbell 14 supported by the upright standards 12. The resting height of the barbell 14 must be varied according to the arm length of the user. As shown in FIGS. 1 and 2, in the preferred embodiment each upright standard 12 contains at least one hole 16, approximately 1 inch in diameter, with each hole 16 facing the user. The greater the number of holes 16 located along the vertical height of the upright standard 12, the wider the range of height adjustability. Welded behind each hole 16, and contained within the structure of the upright standard 12, is a hollow metal pocket 18, approximately three inches deep. The pocket 18 is angled upward at some angle above the horizontal. A solid metal support plug 20, approximately six inches long, slidably fits partially within the pocket 18 so that the plug 20 is supported by the pocket 18 and also extends outward and upward.

The plug 20 supports the barbell 14 which is to be lifted in exercises performed by the user. Only one plug 20 is required in each upright standard 12, since each plug 20 can be inserted into one of several available pockets 18 in order to vary the resting height of the barbell. The plug 20 is prevented from inadvertently falling out of the pocket 18 by the upward angle of the orientation of the pocket 18 containing it. The upward angle of the pocket 18 and plug 20 also prevents the barbell 14 from rolling off its support and falling upon the user. The finite depth of the three-inch deep pocket 18 prevents the plug 20 from sliding in too deep to support the barbell 14.

In another embodiment of the invention as shown in FIG. 3, the upright standards 12 are angled backwards away from the user, while plugs 20 rest within pockets 18 at a 90° angle to the upright standards 12. This embodiment possesses the same barbell-holding effect as the previous embodiment, in that the plugs 20 are still angled upward relative to the floor to better secure the barbell 14, but this embodiment is easier to machine and manufacture.

In a third embodiment of the invention as shown in FIG. 4, the metal support plug 20 is approximately seven inches long and slidably extends through a pair of staggered holes 22 and 24 in each hollow upright standard 12. The pocket 18 of the preferred embodiment is absent, and the upward angle of the support plug 20 is provided by the staggered vertical spacing of the holes 22 and 24. Hole 22 in each pair of staggered holes 22 and 24 is located on the side of the upright standard 12 facing the user. Hole 24 in each pair of staggered holes 22 and 24 is located on the side of the upright standard 12 facing away from the user. Hole 22 is located somewhat vertically higher than hole 24, causing any support plug 20 passing through both holes 22 and 2 to be angled upward toward the user. The support plug 20 is prevented from sliding downward through holes 22 and 24 by an interference between a welded bead 26 located midway along the length of the support plug 20 which does not fit within the circumference of hole 22.

The third embodiment also utilizes the angled upright standards 12 and 90°-angled plugs 20 of the second embodiment, simply by tilting the upright standards 12 away from the user without staggering the relative positions of holes 22 and 24.

The method of weight adjustability for the third embodiment is the same as for the preferred embodiment described above.

While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A device for adjusting the rest height of upright standards in a weight-training machine utilizing a free-moving barbell, comprising;

a weight-training bench with associated upright standards for supporting a free-moving barbell;

support plugs;

at least one hole in each upright standard into which a said support plug slidably fits; and means for retaining said plugs in said standards to support said barbell, said means including said holes being angled such that the angle formed by the intersection of each said upright standard and the extended portion of said support plug extending from said hole is less than 90°.

2. The device according to claim 1 in which said standards each contain more than one said hole for slidably retaining said support plugs.

3. The device according to claim 1 wherein said means for retaining said support plugs comprises pockets located within said standards and behind said holes, said support plugs slidably positionable in said pockets and extending outwardly of said pockets when positioned therein to support said barbell.

4. The device according to claim 1 wherein said means for retaining said support plugs comprises a back hole axially aligned with each said hole in each said upright standard, said support plugs slidably positionable within said hole and said aligned back hole and extending outwardly therefrom toward the user when positioned therein to support said barbell.

5. The device according to claim 4 in which said standards each contain more than one said hole and said aligned back hole for slidably retaining said support plugs.

6. The device according to claim 4 wherein said support plug has a shoulder located intermediate the ends thereof causing an interference between the circumference of said hole and the circumference of said plug.

7. The device according to claim 6 wherein said shoulder is a welded bead.

* * * * *